US007674065B2

(12) United States Patent
Schnedl et al.

(10) Patent No.: US 7,674,065 B2
(45) Date of Patent: Mar. 9, 2010

(54) DEVICE FOR LOCKING THE FINAL POSITIONS OF MOVING SWITCH POINTS

(75) Inventors: Karl Schnedl, Knittelfeld (AT); Herbert Achleitner, Graz (AT); Josef Hörtler, Knittelfeld (AT)

(73) Assignees: VAE Eisenbahnsysteme GmbH, Zeltweg (AT); VAE GmbH, Vienna (AT)

( * ) Notice: Subject to any disclaimer, the term of this patent is extended or adjusted under 35 U.S.C. 154(b) by 709 days.

(21) Appl. No.: 10/485,173

(22) PCT Filed: Jul. 31, 2002

(86) PCT No.: PCT/AT02/00226

§ 371 (c)(1),
(2), (4) Date: Jan. 29, 2004

(87) PCT Pub. No.: WO03/011672

PCT Pub. Date: Feb. 13, 2003

(65) Prior Publication Data

US 2004/0240936 A1 Dec. 2, 2004

(30) Foreign Application Priority Data

Aug. 2, 2001 (AT) ..... A 1208/2001

(51) Int. Cl.
*B61L 5/10* (2006.01)
*B61L 5/04* (2006.01)

(52) U.S. Cl. ..... 403/379.1; 403/322.2; 403/322.3; 403/373; 246/448; 246/450

(58) Field of Classification Search ..... 403/322, 403/322.1, 322.3, 322.4, 373, 374.1, 374.2, 403/374.4, 409.1, DIG. 7; 246/448, 450; 285/314, 316

See application file for complete search history.

(56) References Cited

U.S. PATENT DOCUMENTS

| | | | | | |
|---|---|---|---|---|---|
| 1,761,943 | A | * | 6/1930 | Summers et al. | 403/DIG. 6 |
| 3,442,541 | A | * | 5/1969 | Metz | 403/316 |
| 3,945,744 | A | * | 3/1976 | Metz | 403/317 |

(Continued)

FOREIGN PATENT DOCUMENTS

| | | | |
|---|---|---|---|
| AT | 401 763 | B | 11/1996 |
| AT | 405 925 | B | 12/1999 |
| EP | 0 603 156 | A1 | 6/1994 |
| EP | 0 684 174 | A1 | 11/1995 |

*Primary Examiner*—Daniel P Stodola
*Assistant Examiner*—Ernesto Garcia
(74) *Attorney, Agent, or Firm*—Chapman and Cutler LLP

(57) ABSTRACT

A device for locking end positions of switch parts, having two parts, relatively axially displaceable and positively coupled in at least one direction, including a tube and a rod guided within the tube, at least partially arranged in an outer tube. Locking members cooperate with the parts and outer tube and are displaceable into a locking position in the outer tube's recess. Locking members include ring segments chamfered on insides forming first abutment surfaces converging obliquely toward rod axis. First abutment surfaces cooperate with oblique counter abutment surfaces in a rod recess for holding the rod and the tube coupled during the rod's first displacement path and for urging segments outwardly to emerge from rod recess, and to slide onto the rod's outer surface adjacent rod recess and to immerse into locking position in the outer tube's recess upon rod movement relative to the tube over a second displacement path.

14 Claims, 6 Drawing Sheets

U.S. PATENT DOCUMENTS 4,132,147 A * 1/1979 Contaldo ..... 403/290
4,586,425 A * 5/1986 Redman et al. ..... 91/45
4,614,470 A * 9/1986 Sato et al. ..... 403/322.3
4,715,753 A * 12/1987 Tack ..... 403/322.1
4,863,323 A * 9/1989 Glaser ..... 409/232
5,366,313 A * 11/1994 LaBarre ..... 403/322.2
5,984,266 A * 11/1999 Kotake ..... 285/316
6,095,569 A * 8/2000 Hester ..... 285/321
6,331,091 B2 * 12/2001 Cross ..... 403/325
6,354,541 B1 * 3/2002 Achleitner et al. ..... 246/448
6,460,899 B1 * 10/2002 Ose ..... 285/316
6,752,037 B1 * 6/2004 Miyazawa ..... 403/322.1
6,789,770 B2 * 9/2004 Schnedl ..... 246/448
2004/0069911 A1 * 4/2004 Schnedl ..... 246/448

* cited by examiner

DEVICE FOR LOCKING THE FINAL POSITIONS OF MOVING SWITCH POINTS

BACKGROUND OF THE INVENTION

The invention relates to a device for locking the end positions of movable switch parts and, in particular, movable cross frogs, in which two relatively axially displaceable parts are capable of being displaced into a position coupled with each other in a positive or positive and force-transmitting manner in at least one direction of movement, wherein the relatively displaceable parts are comprised of a tube and a rod guided within the tube and are at least partially arranged in a stationary outer tube and the locking members cooperate with the relatively axially displaceable parts and the outer tube and are capable of being displaced in the radial direction into a locking position in a recess or inner annular groove of the outer tube.

From EP-A 603 156 B1, such a device for locking movable switch parts has already become known, in which the relatively displaceable parts are formed by a tube and a pin guided within the tube, and the locking members are designed as balls or rolls capable of being displaced in the radial direction. Departing from such a device, AT 405 925 B proposed to mount the balls in an expandable ring, or ring comprised of segments. The ring or ring segments constituted some kind of ball cage, allowing for the absorption of high locking forces without premature functional impairment. While balls in the idealized form, in principle, provide but a point contact thus causing a relatively high surface pressure, the cage constituted by the ring, or by the ring segments, in the outwardly displaced locking position provides a surface contact, via which high forces can be taken up as locking forces without any premature deformation or destruction. Such a configuration, however, involves the drawback that its assembly is relatively complicated, because the balls have to be held in an appropriate position during installation before being retained in the respective recess by the resilient ring, or the ring segments held together by springs, in a manner immersed in a rod guided within the tube. Enhanced force absorption, however, is only feasible in the locking position in the axial direction, and in the event of high switching forces the risk of damage to the balls as well as the rod via which the ring segments are displaced into their outer locking position continues to exist unchanged.

SUMMARY OF THE INVENTION

The invention aims to further develop a device of the initially defined kind to the extent that inadmissible surface pressures in the radial direction, which might lead to plastic deformations, cannot be exceeded, neither during the switching procedure nor in the end positions. Furthermore, the configuration according to the invention aims to facilitate both mounting and dismounting. To solve this object, the configuration according to the invention consists essentially in that the locking members are comprised of ring segments whose substantially square or rectangular cross sections are chamfered on their two inwardly located sides while forming first abutment surfaces converging obliquely towards the axis. By using ring segments bearing at least on their inner sides, on both end sides, first abutment surfaces converging obliquely towards the axis, it can be ensured that during the expansion of the ring segments a surface contact will be safeguarded, via which switching forces or retention forces leading to the expansion or compression of the ring segments can be taken up without any risk of plastic deformation. Thus, plastic deformations are also reliably prevented during the switching procedure by the oblique first abutment surfaces acting in the manner of wedge surface to displace the ring segments into their locking position. At the same time, the number of necessary structural components will be reduced due to the omission of the balls as well as fixing means required for the balls, such as ball cages, clamping pins or the like, and, in the main, a countersink involving a smaller cross sectional loss will be required in the inner tube or rod, respectively, since the ring segments need no longer immerse into such countersinks with balls arranged therebetween. That reduction of the required countersink in the internally located inner tube or rod results in a substantial increase in the resistance torque, and hence an enhanced strength and wear resistance at reduced structural dimensions. At the same time, this configuration is also applicable for a plurality of locking planes and, in particular, for the displacement of movable cross frogs, with which high switching forces and high locking forces have to be absorbed and locking is required in two different positions each. The stiffness enhanced by the reduced cross sectional weakening and the enhanced resistance torque of the inner tube are of particular relevance in the case of such multiple locking planes.

According to a preferred further development of the device according to the invention, the configuration is devised such that the angle of chamfer $\alpha$ of the oblique abutment surfaces amounts to between 20 and 35° relative to the radial central plane of the ring segments and is formed parallel with oblique counter abutment surfaces of the rod. Such a choice of the angles of chamfer, or inclination of the oblique abutment surfaces, relative to the radial central plane results in only small frictional forces having to be overcome at relatively small switching forces while maintaining a surface contact, to displace the ring segments into their respective other position. In principle, the inward displacement of the ring segments can be assisted by the use of springs extending about the circumference of the ring segments. Yet, this inward movement can also be initiated by analogous outer chamfers, in which case the configuration is advantageously devised such that the chamfers are provided on the inner and outer circumferences of the ring segments. Additionally, the ring segments can be designed to be expandable against the force of a spring.

In a particularly advantageous manner, the configuration is devised such that the locking members comprise at least three, preferably four, of the ring segments connected by a peripheral tension spring. In principle, it will do in designing ring segments that are outwardly expandable against the force of a spring, to devise the configuration in a manner that the end surfaces extending substantially normal to the locking axis, or the flanks of the chamfered surfaces, are in surface contact with the counter abutment surfaces of the relatively displaceable tubes and/or rods in the respectively outer or inner position of the segments, wherein chamfered surfaces may also be used in the outer position, as already mentioned above.

The optimum surface contact between the ring segments and the rod will be achieved in that the curvature of the inner surfaces of the ring segments corresponds to the curvature of the outer rod diameter. Further improvement will result if, as in correspondence with a preferred further development, the curvature of the outer surfaces of the ring segments corresponds at least partially to the curvature of the inner diameter of the outer tube. By an at least partial adaptation of the curvature of the outer surfaces of the ring segments to the curvature of the inner diameter of the outer tube, any possible line contact will be avoided such that the friction occurring during the switching procedure will be substantially reduced even in the absence of annular springs on account of the uniform surface pressure applied.

BRIEF DESCRIPTION OF THE SEVERAL VIEWS OF THE DRAWINGS

In the following, the invention will be explained in more detail by way of an exemplary embodiment schematically illustrated in the drawing. Therein.

DETAILED DESCRIPTION OF THE INVENTION

Figure 1:
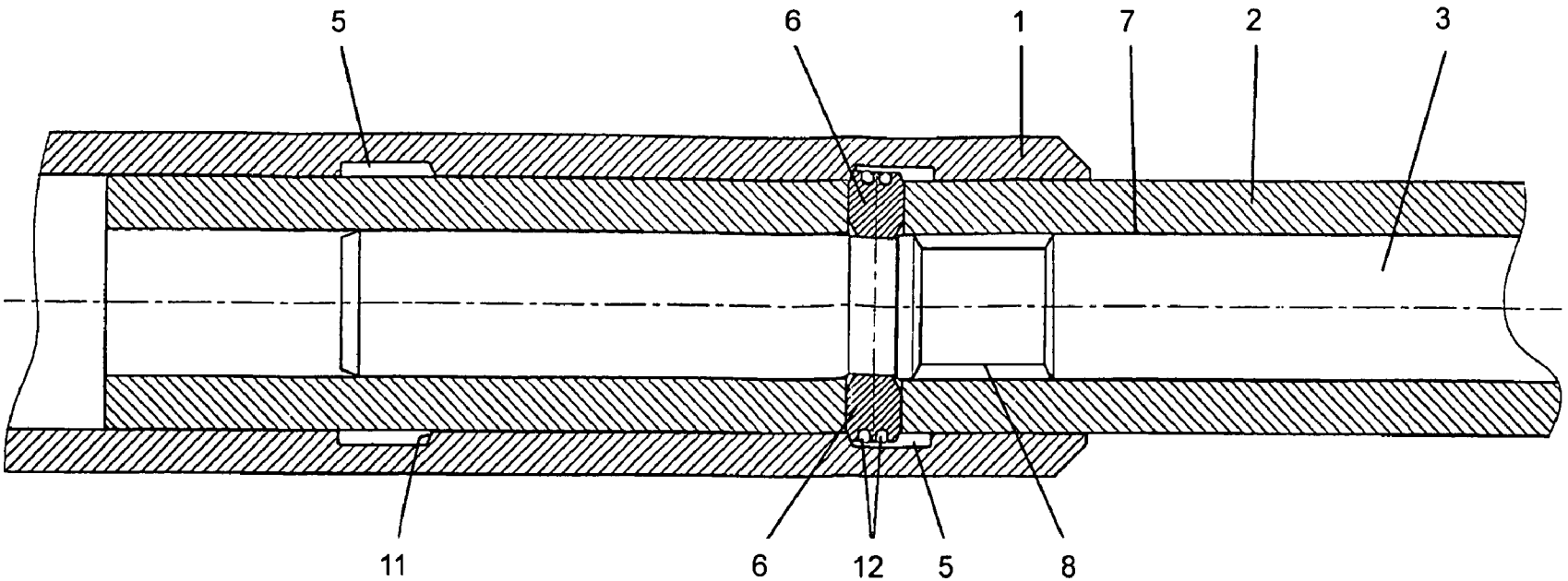
FIG. 1 depicts a first displacement position of ring segments while locking an end position on the right-hand side of the drawing.
Figure 6:
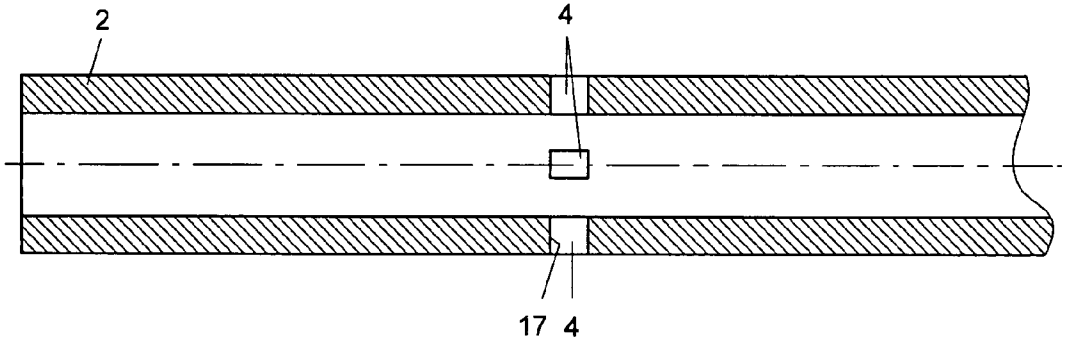
FIG. 6 depicts the inner tube.
Figure 7:
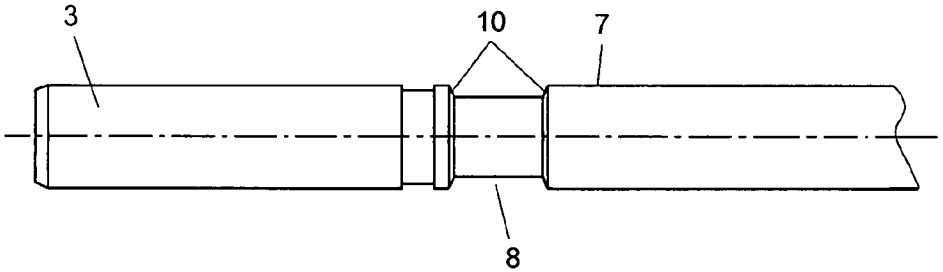
FIG. 7 depicts the rod.

In FIG. 1, an inner tube 2 and a rod 3 are relatively movably guided within an outer tube 1. The inner tube 2 includes radial openings 4, as shown in FIG. 6. The outer tube 1 comprises recesses 5 in which ring segments 6 are immersed in the locking position. In the illustration according to FIG. 1, the ring segments 6 are outwardly displaced, ascending on an outer surface 7 of the inner rod 3 with an accordingly larger diameter, and thus being displaced outwardly and immersed in a first recess 5 of the outer tube 1.

Figure 2:
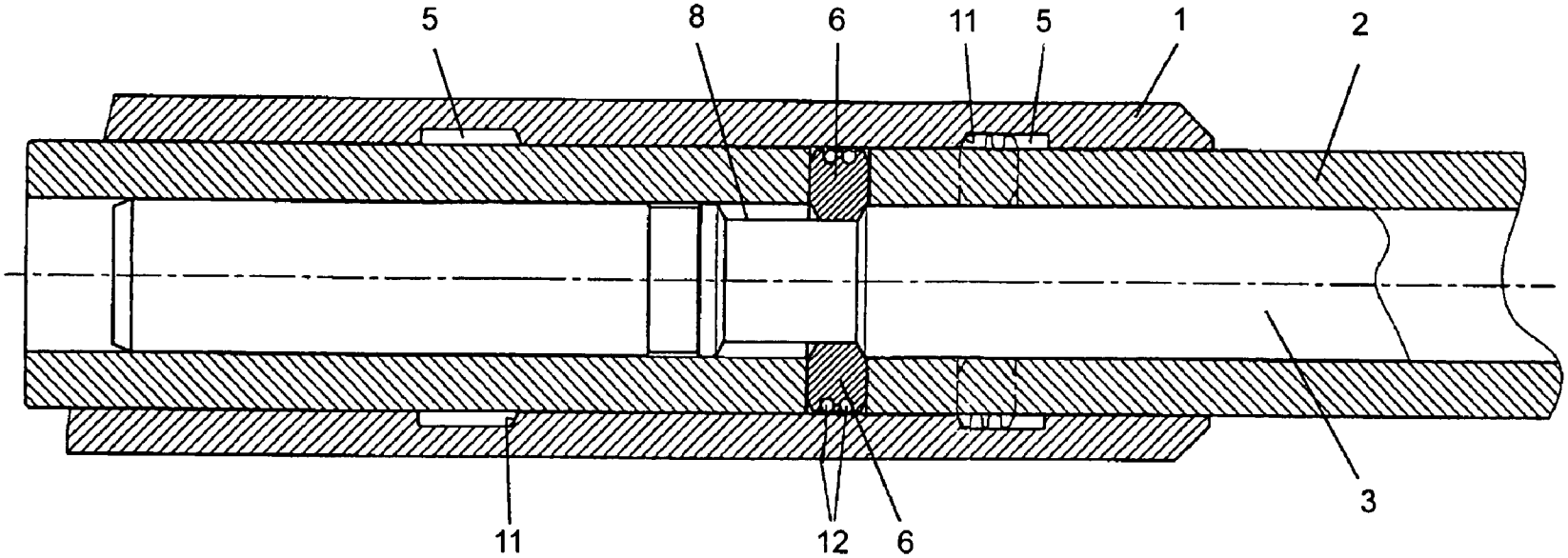
FIG. 2 illustrates the configuration according to FIG. 1 during the switching procedure.

The rod 3 comprises a turned-out region or recess 8, in which the ring segments 6 can immerse during the switching procedure, thus getting out of engagement and into a position in which displacement is feasible without locking. This is elucidated in FIG. 2.

Figure 3:
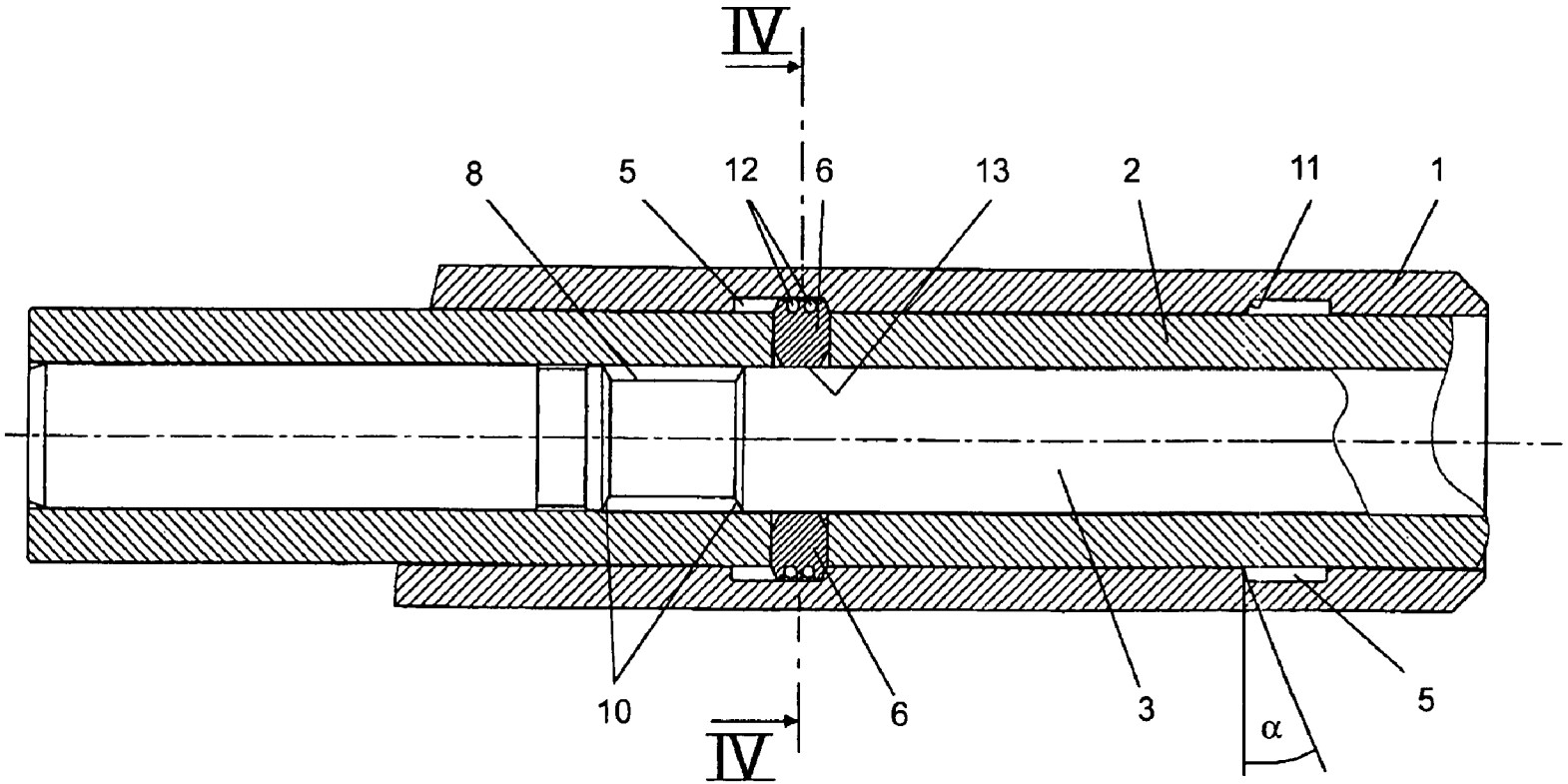
FIG. 3 depicts the locked end position on the left-hand side as required for cross frogs, with FIG. 4 showing a section along line IV-IV through locking members designed as ring segments.
Figure 4:
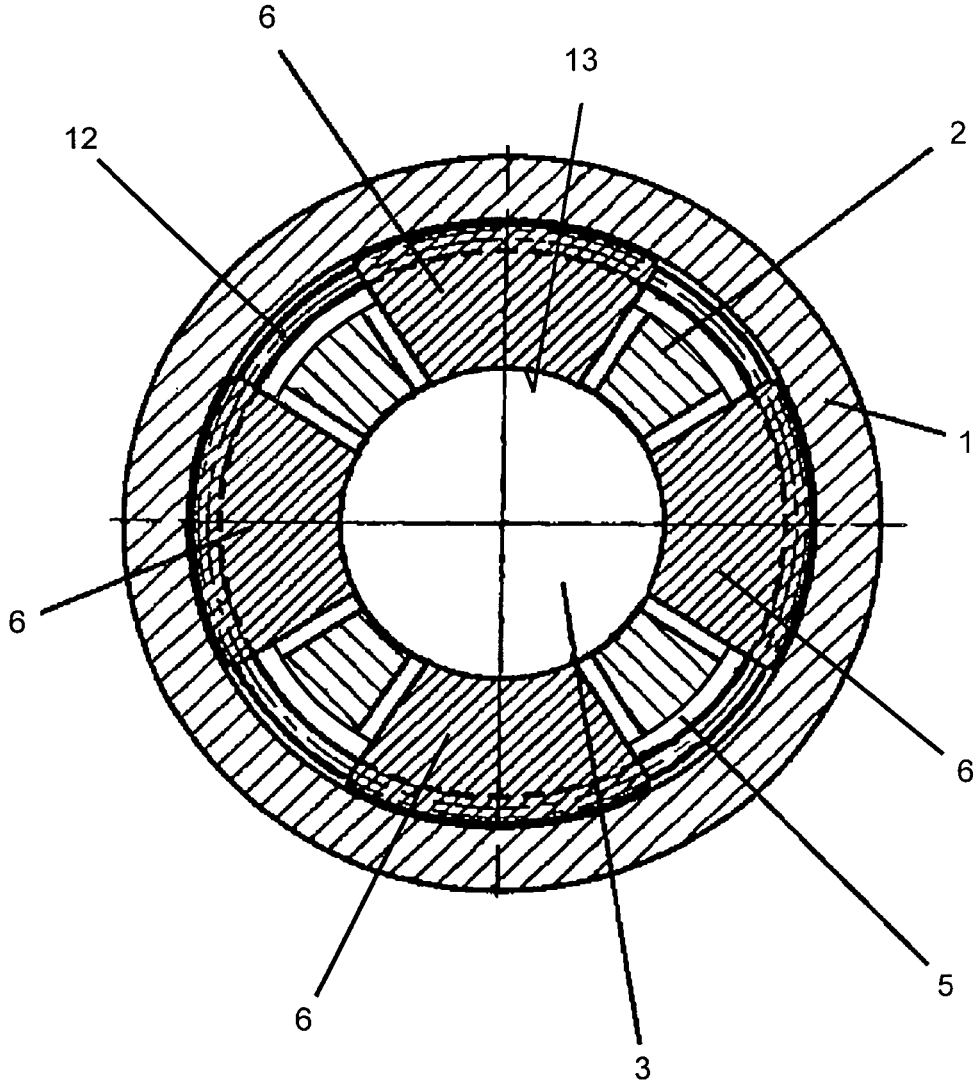
Figure 5:
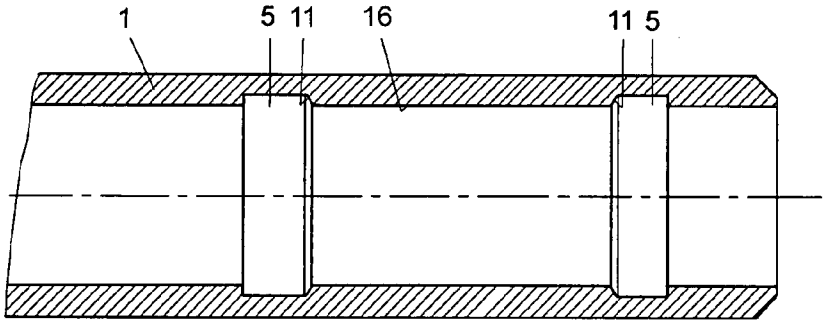
FIG. 5 depicts the outer tube.
Figure 8:
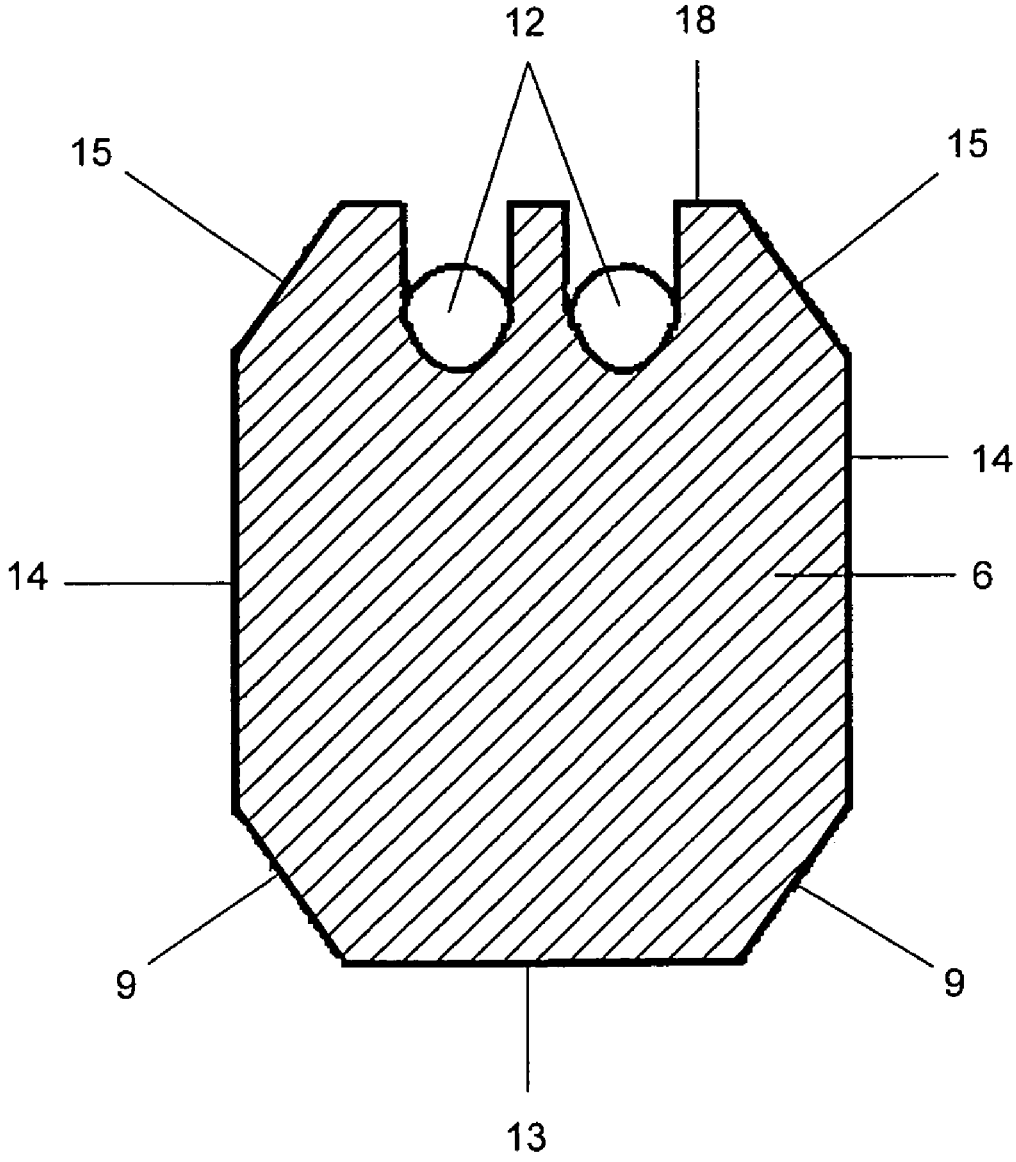
FIG. 8 depicts a ring segment.

In FIG. 3, the displacement of the rod 3 relative to the tube 2 into the second end position is illustrated, with the locking members (ring segments 6) having been displaced into the respective second recess 5 of the outer tube 1. The switching procedure and hence the expansion or inward displacement of the ring segments 6 is feasible via first oblique abutment surfaces 9 and second oblique abutment surfaces 15 provided on the end sides of the ring segments 6 and cooperating with respectively oblique counter abutment surfaces 10 of the rod and 11, respectively, in the recesses 5 of the outer tube 1. A surface contact is each maintained along these oblique surfaces 9, 10 and 11, respectively, wherein the angle of chamfer $\alpha$ is chosen with a view to readily enabling the respective inward or outward displacement. The ring segments 6 as illustrated in FIG. 4 can additionally be prestressed in the sense of an inward displacement by tension springs 12 being interposed, the locking position of the ring segments 6 in FIG. 4 being seen to correspond with the position illustrated in FIG. 3, in which the ring segments 6 are outwardly displaced by the rod 3 and pressed into the grooves of the outer tube 1. Straight end surfaces of the ring segments 6 are identified by reference numeral 14, as shown in FIG. 8, which cooperate with corresponding abutment surfaces 17 of the radial openings 4 (FIG. 6).

In order to substantially reduce the surface pressures in the locked position, the curvature of the inner surfaces 13 of the ring segments is adapted to the curvature of the outer surface 7 of the rod 3. Existing retention or vibration forces can, thus, be absorbed in a particularly structural-component-saving manner. Further, curvature of the outer surface 18 of the ring segments 6 corresponds at least partially to curvature of the inner surface 16 of the outer tube.

The invention claimed is:

1. A device for locking the end positions of movable switch parts, comprising two relatively axially displaceable parts capable of being displaced into a position coupled with each other in a positive manner in at least one direction of movement, wherein the relatively displaceable parts comprise a tube (2) and a rod (3) guided within the tube (2) and are at least partially arranged in an outer tube (1), and locking members cooperate with the relatively axially displaceable parts (2, 3) and the outer tube (1) and are capable of being displaced in the radial direction into a locking position in a recess (5) of the outer tube (1), wherein the locking members comprise ring segments (6) whose substantially rectangular cross sections are chamfered on their two inwardly located sides forming first abutment surfaces (9) converging obliquely toward an axis of the rod (3), wherein said first abutment surfaces (9) cooperate with oblique counter abutment surfaces (10) provided in a recess (8) of the rod (3) for holding the rod (3) and the tube (2) in said position coupled with each other during a first displacement path of the rod (3) in a direction of movement and for urging the ring segments (6) in an outward direction to emerge from said recess (8) of the rod (3) and to slide onto an outer surface (7) of the rod (3) adjacent said recess (8) of the rod (3) and to immerse into said locking position in the recess (5) of the outer tube (1) upon movement of the rod (3) relative to the tube (2) over a second displacement path in said direction of movement, wherein curvature of an inner surface (13) of the ring segments (6) corresponds to curvature of said outer surface (7) of the rod (3) adjacent said recess (8) of the rod (3) and curvature of an outer surface (18) of the ring segments (6) corresponds at least partially to curvature of an inner surface (16) of the outer tube (1) adjacent said recess (5) of the outer tube (1).

2. A device according to claim 1, wherein an angle of chamfer ($\alpha$) of the first abutment surfaces (9) is between 20 and 35° relative to a radial central plane of the ring segments (6) and is formed parallel with the counter abutment surfaces (10) of the rod (3).

3. A device according to claim 2, wherein the ring segments (6) are expandable against a force of a spring.

4. A device according to claim 2, wherein one of the first abutment surfaces (9) of the ring segments (6) is in surface contact with the counter abutment surface (10) of the rod (3) in an inner position of the ring segments (6).

5. A device according to claim 1, wherein the ring segments (6) are chamfered on their two outwardly located sides forming oblique second abutment surfaces (15).

6. A device according to claim 5, wherein the ring segments (6) are expandable against a force of a spring.

7. A device according to claim 5, wherein one of the second abutment surfaces (15) of the ring segments (6) is in surface contact with a counter abutment surface (11) of the outer tube (1) in an outer position of the ring segments (6).

8. A device according to claim 1, wherein the locking members comprise at least three of the ring segments (6) connected by a peripheral tension spring, wherein the segments (6) are displaceable in the radial direction against a force of the spring.

9. A device according to claim 8, wherein one of the first abutment surfaces (9) of the ring segments (6) is in surface contact with the counter abutment surface (10) of the rod (3) in an inner position of the ring segments (6).

10. A device according to claim 8, wherein one of the second abutment surfaces (15) of the ring segments (6) is in surface contact with a counter abutment surface (11) of the outer tube (1) in an outer position of the ring segments (6).

11. A device according to claim 1, wherein one of the first abutment surfaces (9) of the ring segments (6) is in surface contact with the counter abutment surface (10) of the rod (3) in an inner position of the ring segments (6).

12. A device according to claim 11, wherein one of the second abutment surfaces (15) of the ring segments (6) is in surface contact with a counter abutment surface (11) of the outer tube (1) in an outer position of the ring segments (6).

13. A device according to claim 1, wherein the two relatively axially displaceable parts capable of being displaced into a position coupled with each other are coupled in a positive and force-transmitting manner in at least one direction of movement.

14. A device according to claim 1, wherein the recess (5) of the outer tube (1) is an inner annular groove of the outer tube (1).

* * * * *